US005791998A

United States Patent [19]

Moser et al.

[11] Patent Number: 5,791,998

[45] Date of Patent: Aug. 11, 1998

[54] AMUSEMENT RIDE FEATURING A NUMBER OF CARS

[75] Inventors: Alfeo Moser; Claudio Soriani, both of Melara, Italy

[73] Assignee: Soriani & Moser, Melara, Italy

[21] Appl. No.: 533,959

[22] Filed: Sep. 26, 1995

[30] Foreign Application Priority Data

Sep. 27, 1994 [IT] Italy ..... BO94A0420

[51] Int. Cl.[6] ..... A63G 1/28

[52] U.S. Cl. ..... 472/31; 472/46

[58] Field of Search ..... 472/30, 31, 32, 472/33, 34, 3, 44, 45, 46

[56] References Cited

U.S. PATENT DOCUMENTS

| | | | |
|---|---|---|---|
| 3,707,282 | 12/1972 | Robinson | 472/46 X |
| 3,840,225 | 10/1974 | Fouché | 472/3 |
| 4,302,004 | 11/1981 | Deam et al. | 472/3 |
| 5,306,211 | 4/1994 | Pasquier | 472/3 |
| 5,395,290 | 3/1995 | Knijpstra | 472/31 |

*Primary Examiner*—Kien T. Nguyen

*Attorney, Agent, or Firm*—Royston Rayzor Vickey Novak & Druce

[57] ABSTRACT

An amusement ride presenting a column fitted to a beam which pivots about a pin on the platform and is connected to the column by at least one jack. The column is fitted in articulated manner with four blocks, each presenting a horizontal pin about which pivots one end of a roundabout supporting member, and a support rotating about the supporting member presents a number of cars with which it forms a roundabout. Each car is mounted on two pins of the support, presents an axis perpendicular to the rotation axis of the support, and may be rotated through a full turn by centrifugal force. Each block is normally locked in relation to the column by means of a key, and the supporting member is in the form of a boom fitted in articulated manner with an L-shaped arm and in turn integral with a shaft about which the support rotates, so that the shaft may be inclined by an angle of over 90 degrees in relation to its idle position. For transfer from one site to another, the column and the beam are fitted to the bed of a tired vehicle, and the keys are removed to rotate the blocks and position the supporting members in pairs parallel to the axis of the vehicle.

15 Claims, 7 Drawing Sheets

Fig.1
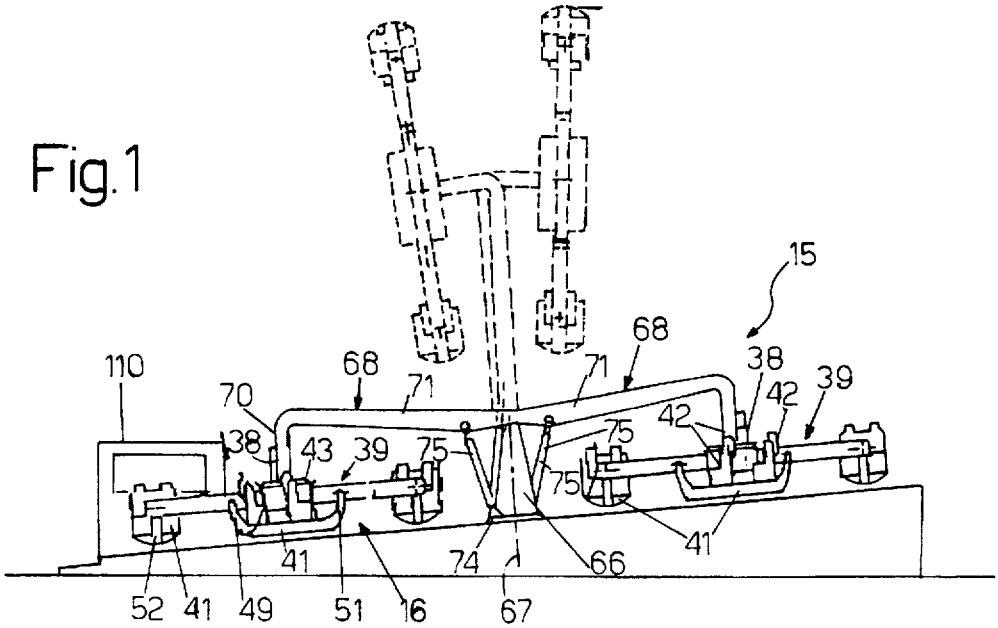
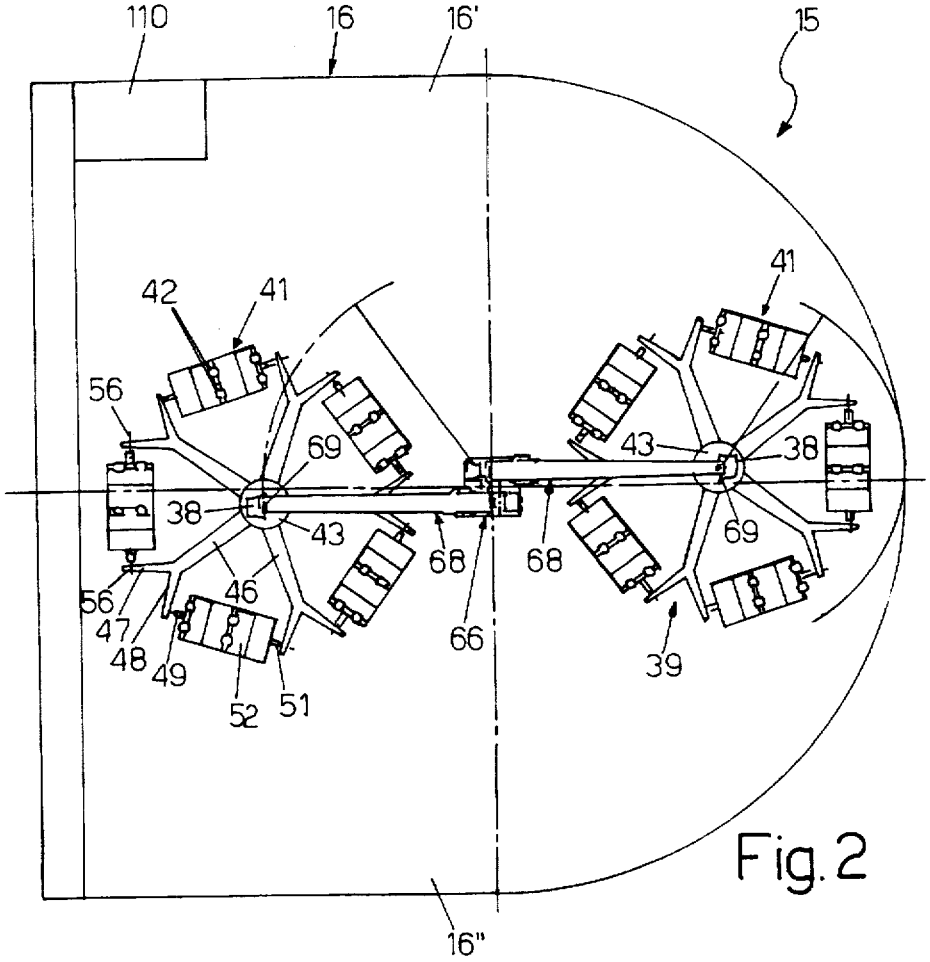
Fig.2

Fig.6
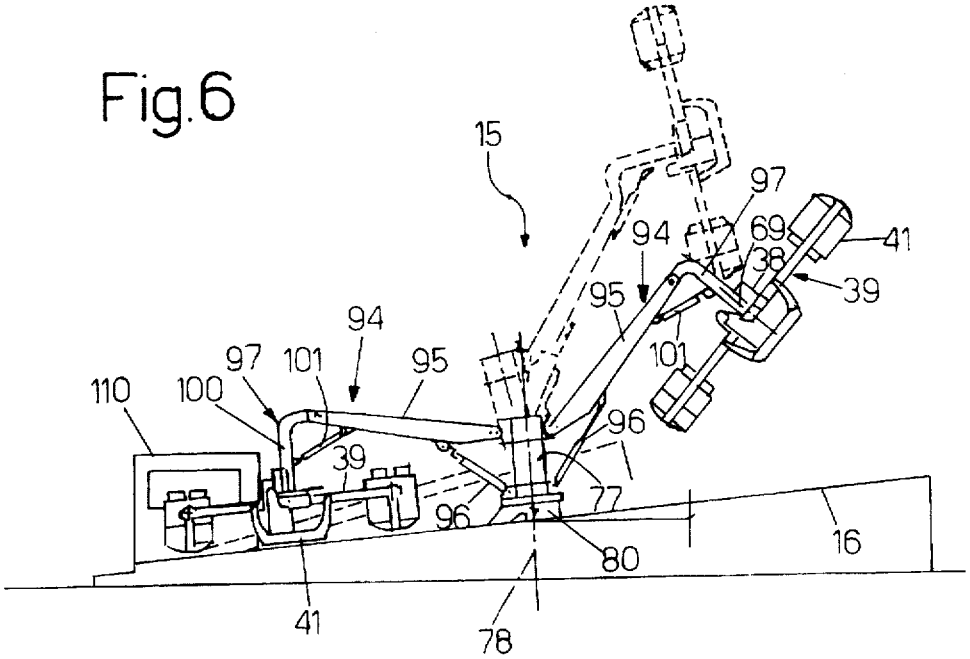
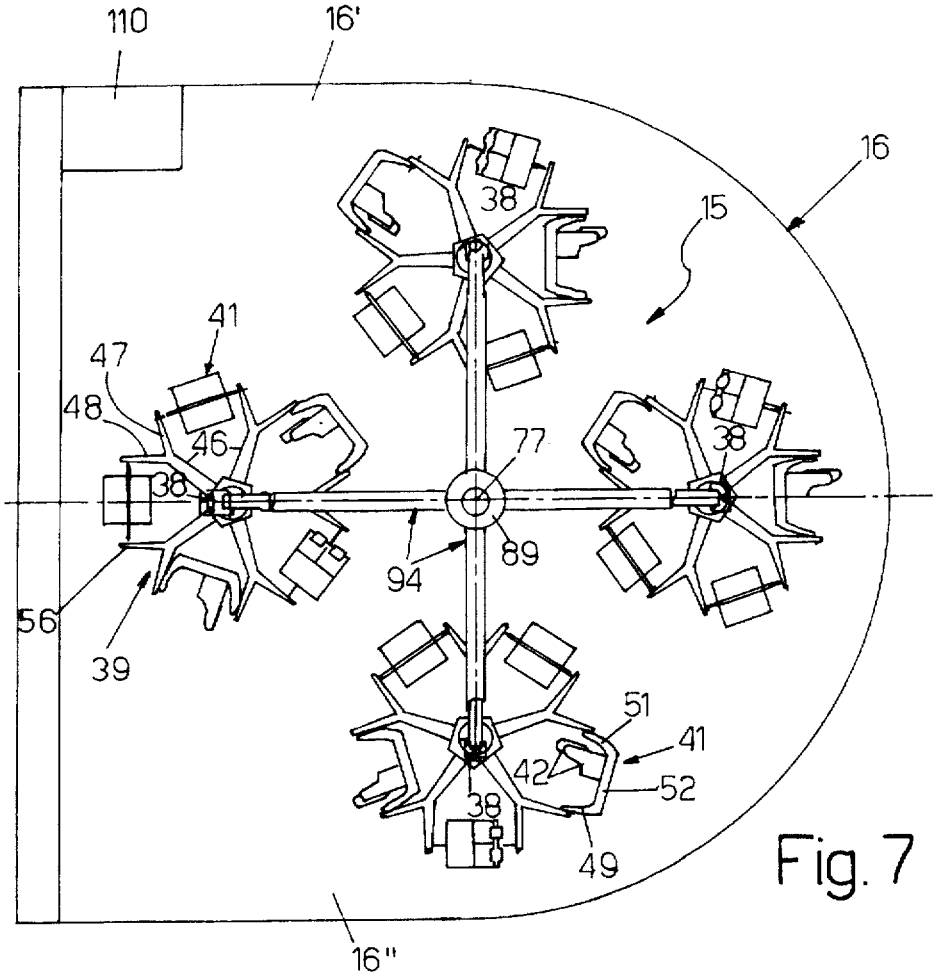
Fig. 7

86
80
87
84
85
81
83
82
79
95
94
99
98
101
97
100
69
38

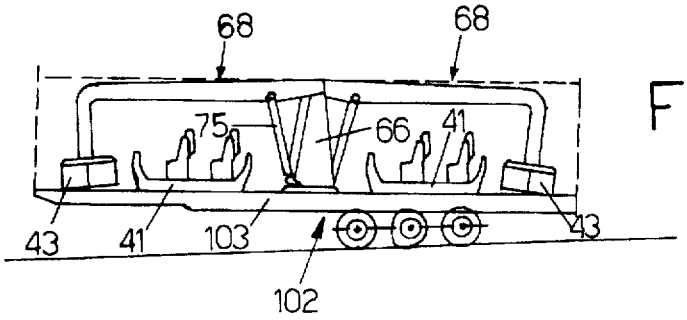
Fig.14
Fig.15
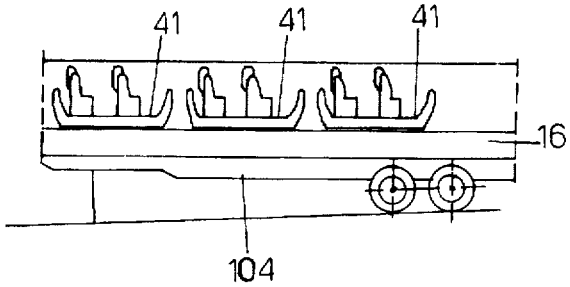
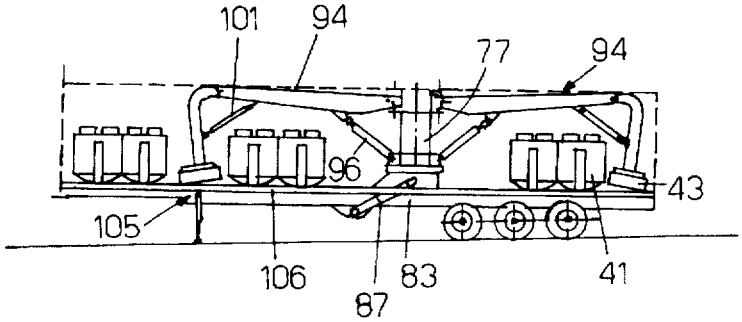
Fig.16
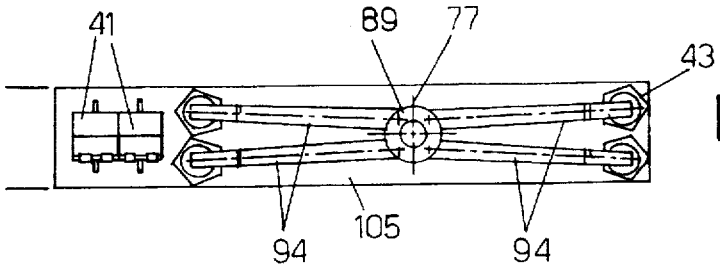
Fig.17
Fig.18
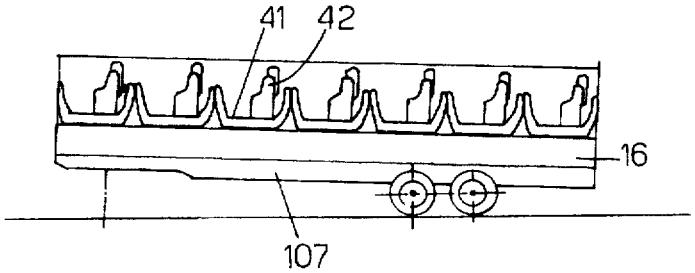
Fig.19
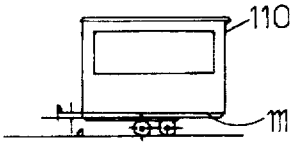

AMUSEMENT RIDE FEATURING A NUMBER OF CARS

BACKGROUND OF THE INVENTION

The present invention relates to an amusement ride featuring a number of cars, each for accommodating at least one passenger.

Various types of amusement rides are known featuring a revolving column and a number of cars, which are rotated irregularly to achieve an exciting movement varying in speed and direction, and which are therefore of complex design. Other known types exploit centrifugal force to maintain the passenger in a given position in opposition to the force of gravity; and in each type the cars are rotated about an axis substantially parallel to that of the column.

Moreover, transferring rides of the above type from one site to another involves dismantling them entirely for loading on to a vehicle, which is invariably highly complicated and expensive.

SUMMARY OF THE INVENTION

It is an object of the present invention to provide an amusement ride designed to overcome the aforementioned drawbacks typically associated with known types, and which, in particular, provides for a more flexible movement of the cars, and may be transferred easily from one site to another.

According to the present invention, there is provided an amusement ride comprising a number of cars, each for accommodating at least one passenger; a support for supporting at least two cars and forming a roundabout, said support rotating about a first axis and in relation to a roundabout supporting member; and means for rotating said support in relation to said supporting member; characterized in that said supporting member is connected by an articulated joint to a column rotating about a substantially vertical second axis.

According to a further characteristic of the present invention, said column is fitted to a platform forming the bed of a tired vehicle, for enabling trouble free transfer of the ride.

BRIEF DESCRIPTION OF THE DRAWINGS

Two preferred, non-limiting embodiments of the present invention will be described by way of example with reference to the accompanying drawings, in which:

FIG. 1 shows a schematic side view of a first embodiment of an' amusement ride in accordance with the present invention;

FIG. 2 shows a plan view of the FIG. 1 ride;

FIGS. 6, 7, 8 show three views, similar to FIGS. 1–3, of a further embodiment of an amusement ride in accordance with the present invention;

FIGS. 14 and 15 show side views of the FIG. 1–5 ride loaded on two vehicles;

FIGS. 16 and 17 show respective side and plan views of the FIG. 6–11 ride loaded on one vehicle;

FIG. 18 shows a side view of a vehicle, similar to that in FIG. 15, for the FIG. 6–13 ride;

FIG. 19 shows a side view of an auxiliary vehicle for both embodiments of the ride according to the present invention.

DETAILED DESCRIPTION OF THE INVENTION

Figure 3:
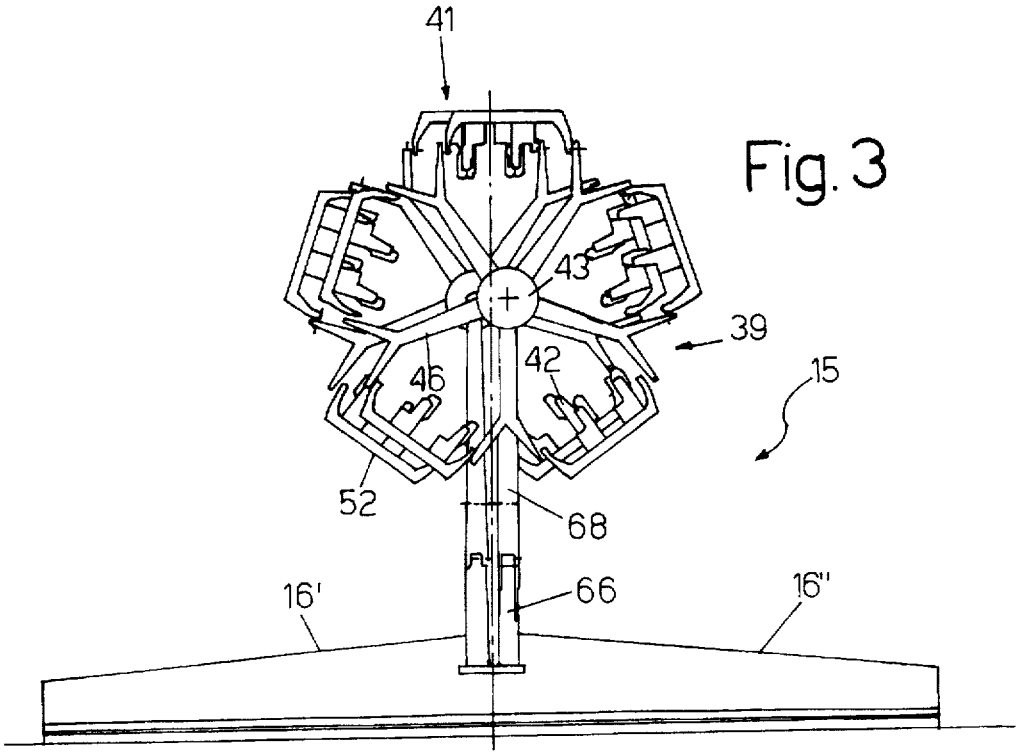
FIG. 3 shows a front view of the FIG. 1 ride in one operating position.

Number 15 in FIGS. 1–3 indicates an amusement ride comprising a platform 16 in turn comprising two parts 16' and 16" eloping slightly on either side, and the edge formed by parts 16' and 16" slopes slightly in relation to the horizontal. In the center of platform 16, there extends upwards a strong column 66 which, by means of a known geared motor (not shown), is rotated in relation to platform 16 about a substantially vertical axis 67.

Column 66 is fitted in articulated manner with at least two roundabout supporting members 68, each fitted at one end with a fixed shaft 69 in turn fitted in rotary manner with a support 39 for a set of cars 41. Each car 41 presents at least one single-passenger seat 42, so that support 39 and respective cars 41 form a roundabout; and support 39 comprises a hub 43 rotated in relation to shaft 69 by a further geared motor 38.

Hub 43 is fitted removably with five spokes 46 (FIG. 2) equally spaced angularly and each terminating with two branches 47, 48 forming an angle equal to the angle between two adjacent spokes 46, so that branch 47 of one spoke 46 is parallel to branch 48 of one of the adjacent spokes 46. The ends of each two parallel branches 47, 48 are fitted in articulated manner with two arms 49, 51 fitted rigidly to a supporting structure 52 of a respective car 41.

More specifically, each branch 47, 48 of spoke 46 is fitted in rotary manner, by means of a rolling bearing, with a respective pin 56 fitted to relative arm 49, 51 of structure 52, so that car 41 rotates about the axis of pins 56, which is perpendicular to, but not coplanar with, the axis of shaft 69 (FIG. 1). The two pins 56 are so located that the center of gravity of car 41 is normally below their axis; and at least one pin 56 supporting car 41 presents a mechanical brake **56*a* operated from inside car 41**.

Each car 41 comprises a group of seats 42, each for accommodating one passenger and fitted with a safety belt. More specifically, seats 42 are arranged in pairs in two rows perpendicular to the axis of pins 56, so that the passengers are oriented tangentially in relation to the axis of support 39.

Figure 4:
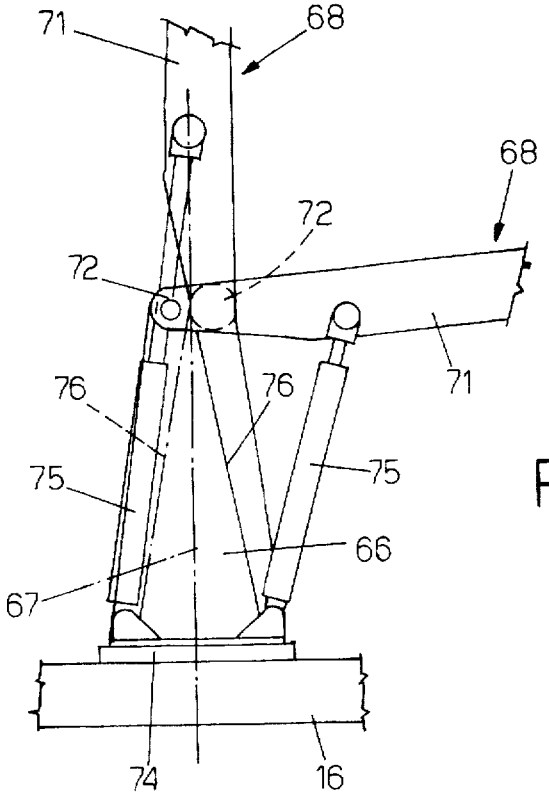
FIG. 4 shows a larger-scale detail of FIG. 1 in one operating position.
Figure 5:
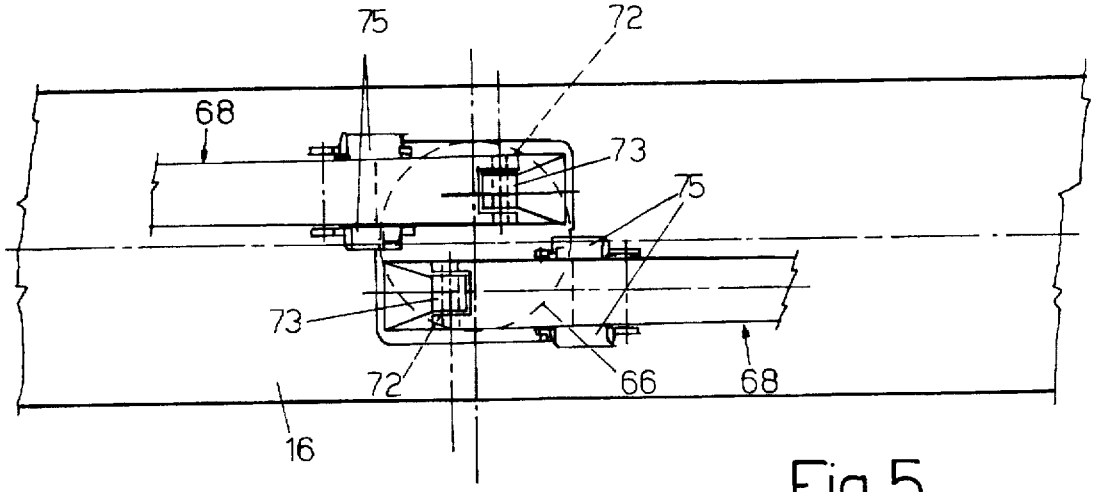
FIG. 5 shows a plan view of the FIG. 4 detail.

Each roundabout supporting member 68 is in the form of an L-shaped boom comprising a short arm 70 fitted on the end with shaft 69 about which support 39 rotates; and a long arm 71, the end of which (FIGS. 4, 5) pivots about a pin 72 fitted to a corresponding appendix 73 of column 66 which tapers upwards and presents a substantially square flange 74 at the bottom.

The two appendixes 73 are so located at the top end of column 66 that the two pins 72 are parallel but slightly offset in relation to each other in the direction of supporting members 68, which are thus substantially diametrically opposite each other on column 66. Each supporting member 68 is connected to flange 74 by a pair of hydraulic jacks 75, each comprising, for example, a hydraulic cylinder; and the lateral surface of column 66 presents depressions 76 for housing jacks 75 in the extended position.

Each pair of jacks 75 may be operated by partially or fully extending the cylinders, so that boom 68 is rotated roughly 90°, in a radial plane in relation to column 66, into the substantially vertical position shown in FIG. 3 and by the dotted line in FIG. 1.

Column 66 and supports 39 are rotated simultaneously or alternately with the upward rotation of supporting member 68; the spin produced by the rotation of support 39 rotates cars 41 about pins 56 so that seats 42 are positioned radially in relation to the axis of support 39 (FIG. 3), and car 41 may easily be pushed bodily by the passengers into a full turn; and rotation of car 41 is controllable using the respective brake. Ride 15 therefore provides for an enormous increase in the flexibility of the movement of cars 41, and hence in enjoyment.

Figure 8:
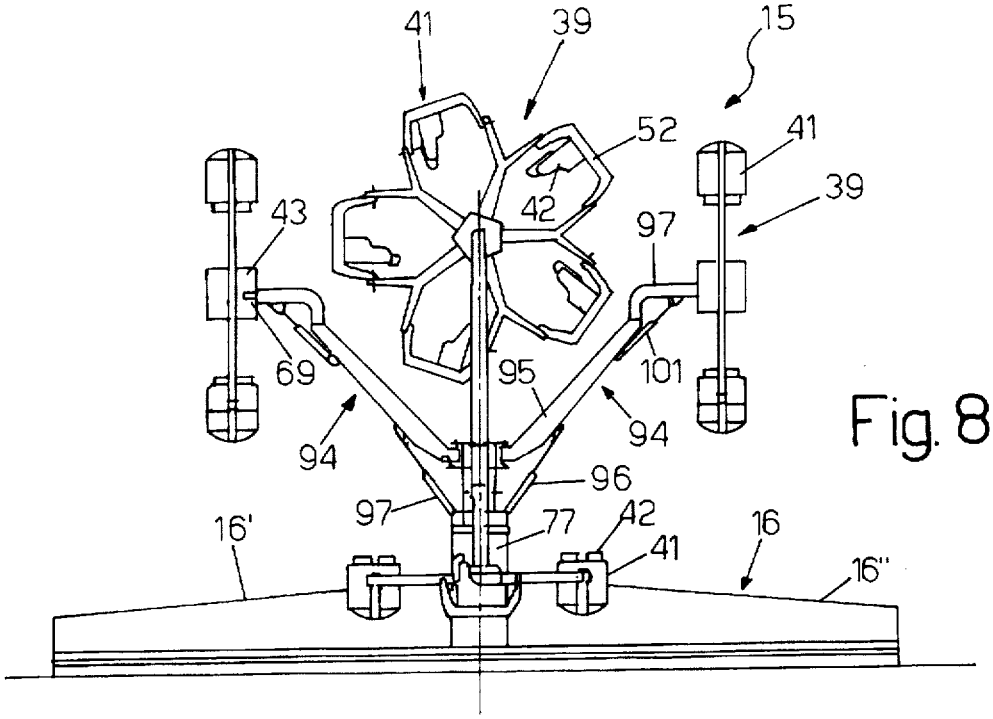
Figure 9:
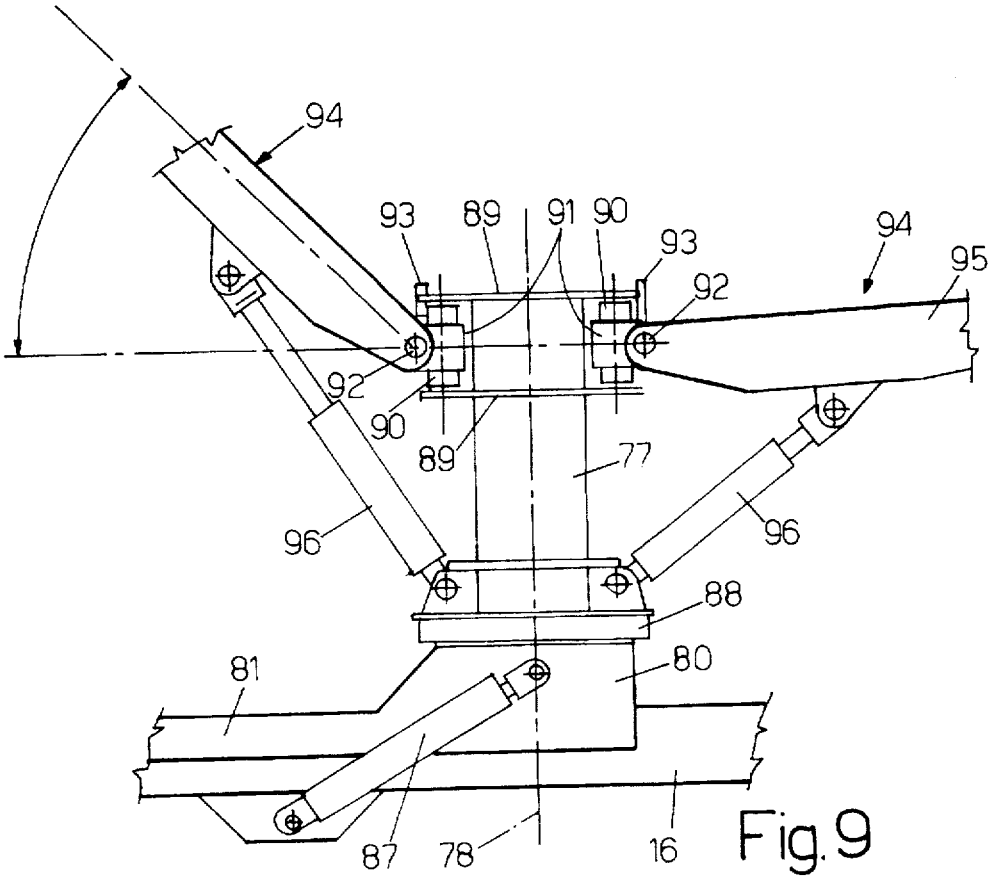
FIGS. 9 and 10 show respective larger-scale side and plan views of a detail in FIG. 6.
Figure 10:
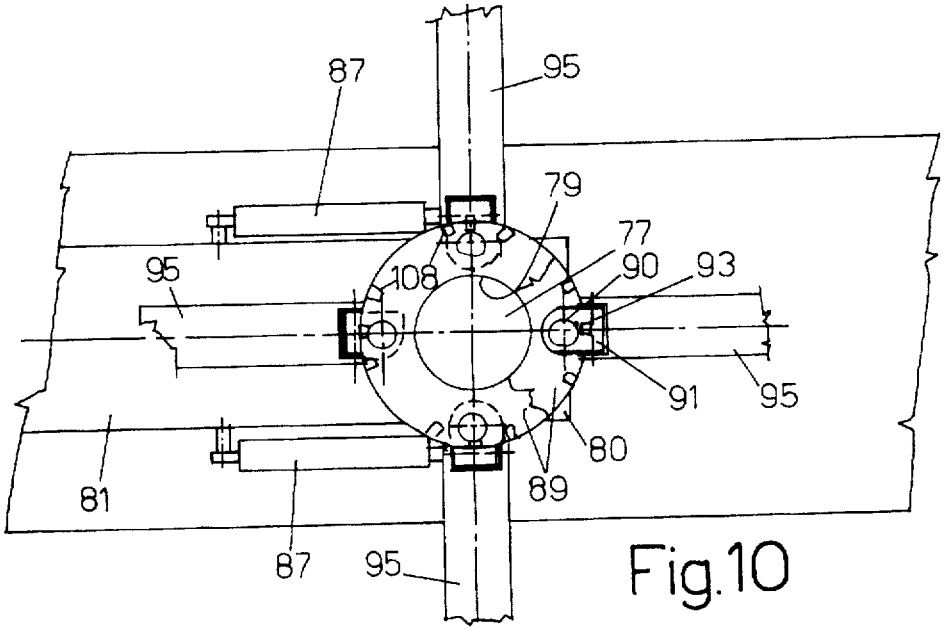
Figures 11, 12, 13:
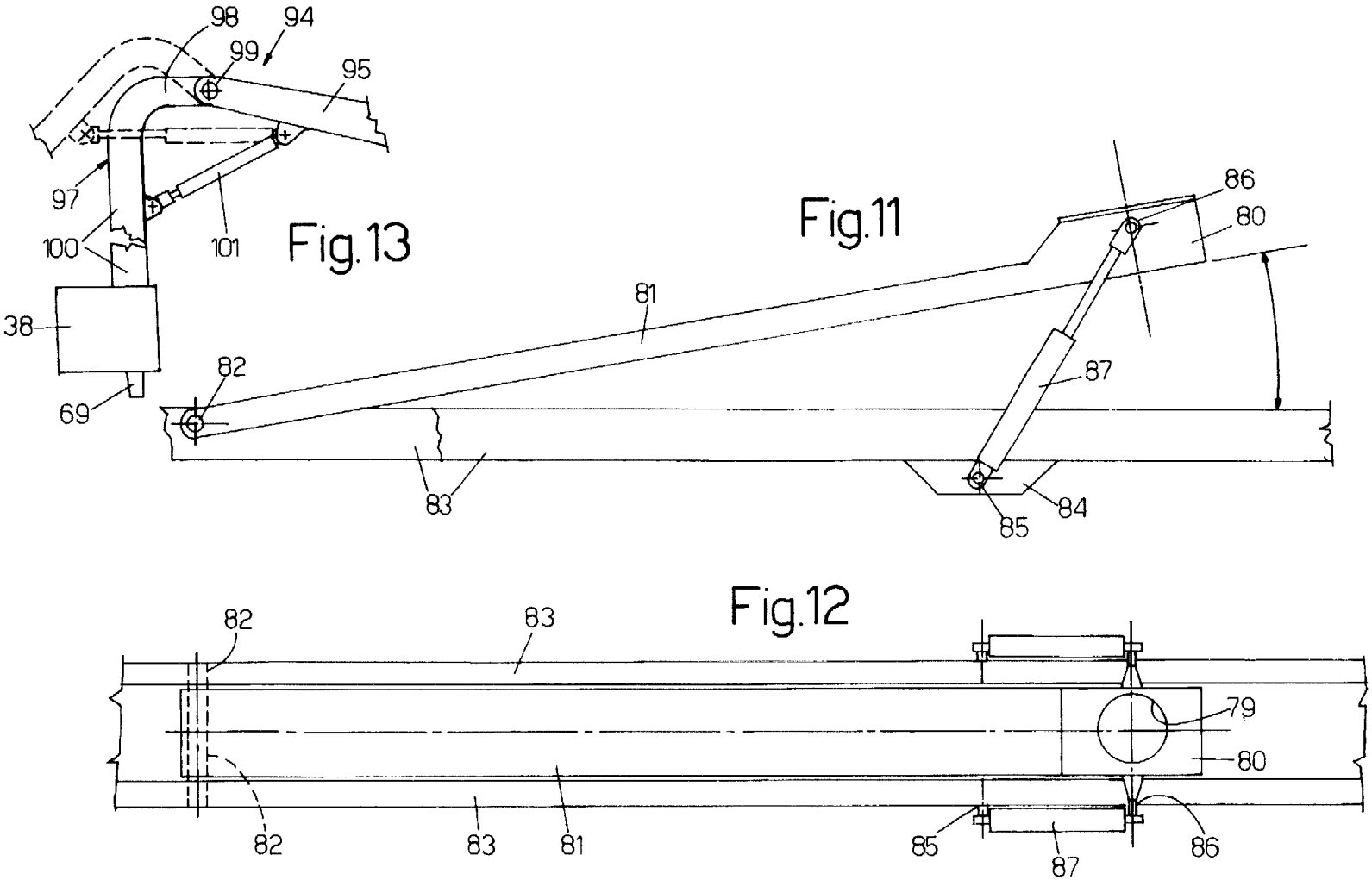
FIGS. 11 and 12 show respective larger-scale side and plan views of 8 second detail in FIG. 6.
FIG. 13 shows a further larger-scale detail of FIG. 6.

In the FIG. 6–8 embodiment, ride 15 comprises a column 77 presenting a substantially vertical axis 78, and rotating inside a seat 79 in a support 80 (FIGS. 9, 10) fitted to a strong beam 81; and beam 81 pivots about a pin 82 (FIGS. 11, 12) fitted to a pair of ribs 83 which provide for guarding beam 81 in the idle position and are therefore recessed inside platform 16 (FIGS. 6–8) which is the same as in FIGS. 1–3.

Each rib 83 (FIGS. 11, 12) presents an appendix 84 with a pin 85; and between pin 85 and a pin 86 on either side of support 80, there extends a respective hydraulic jack 87 for rotating beam 81 through a maximum angle of, say, 10°.

Column 77 is integral at the bottom with a strong ring 88 (FIGS. 9, 10), and is fitted at the top with a pair of flanges 89 between which are fitted four pins 90 parallel to the axis of column 77 and 90° apart. Each pin 90 is fitted with a block 91 in turn fitted with an articulated joint comprising a pin 92 perpendicular to pin 90; and, for the reason explained later on, block 91 is normally connected to at least one of flanges 89 by a key 93.

About each pin 92, there pivots one end of a roundabout supporting member indicated as a whole by 94; and the roundabout in FIGS. 6–8 is substantially the same as in FIGS. 1–3, except that spokes 46 are shorter, and cars 41 present only two passenger seats 42 aligned in one row oriented radially in relation to the axis of column 77.

Supporting member 94 comprises a substantially straight boom 95 connected at one end to ring 88 of column 77 (FIG. 9) by a respective hydraulic jack 96 for rotating boom 95 radially in relation to column 77 through a maximum angle of, say, 45°. Member 94 also comprises an L-shaped arm 97 (FIGS. 6, 13), the shorter side 98 of which is connected in articulated manner by a pin 99 to the other end of boom 95, and the longer side 100 of which is integral with shaft 69 about which support 39 rotates. Between boom 95 and side 100 of arm 97, there extends a further hydraulic jack 101 for rotating arm 97 in relation to boom 95 through a maximum angle of, say, 45°.

The FIG. 6–13 ride operates as follows.

Normally, jacks 87 (FIGS. 11, 12) position beam 81 substantially horizontally, jacks 96 (FIGS. 9, 10) position booms 95 horizontally, and jacks 101. (FIG. 13) position the longer sides 100 of arms 97 vertically, so that each support 39 is lowered to enable passengers to get in and out of cars 41 from platform 16.

Once the passengers are seated and the safety belts fastened, jacks 87 (FIGS. 9–12) rotate beam 81 about pin 82; column 77 moves into the raised position (shown by the dotted line in FIG. 6) to position cars 41 of the roundabouts at a safe distance from platform 16; the relative geared motor rotates column 77; and geared motors 38 rotate supports 39 about their respective axes.

The spin imparted to cars 41 rotates them about the axis of pins 56, as in the previous case; jacks 96 rotate booms 95 separately in relation to column 77; and jacks 101 rotate arms 97 separately in relation to booms 95. The axis of each support 39 is thus rotated into the position shown by the dotted line in FIG. 6, wherein it is rotated roughly 100°, i.e. well over 90°, in relation to the initial vertical position.

In the course of one full turn of column 77, the axis of support 39 oscillates between 80° and 110° in relation to the initial position, so that, when the two lateral supports 39 are positioned as in FIG. 8, said axis is horizontal, thus enabling cars 41 to be swung easily through a complete turn by centrifugal force and the thrust exerted by the passengers. Obviously, partially extending jacks 96 and 101 provides for achieving any intermediate position between the one shown by the dotted line in FIG. 6, and the subhorizontal position of the front roundabout in FIG. 8.

According to a further characteristic of the present invention, column 66, 77 of ride 15 is fitted permanently to a tired vehicle for troublefree transfer from one site to another. More specifically, column 66 in the FIG. 1–5 embodiment is fitted to the trailer 102 (FIG. 14) of a tractor semitrailer, the bed 103 of which forms part of platform 16. The rest of platform 16 is dismantled and loaded separately, e.g. on to another tired trailer (FIG. 15).

For transfer, cars 41 (FIGS. 1–3) are removed from spokes 46 of support 39; spokes 46 are removed from hub 43 which is left connected to shaft 69; column 66 is rotated so that the two supporting members 68 are parallel to the axis of trailer 102 and the two hubs 43 rest on bed 103 (FIG. 14); two cars 41 are loaded side by side between column 66 and each hub 43; and the other cars 41 are loaded side by side in pairs on the other trailer 104 (FIG. 15).

Column 77 of the FIG. 6–13 ride 15 is fitted permanently to the trailer 105 (FIG. 16) of a tractor semitrailer, the bed 106 of which forms part of platform 16 and is fitted with the two ribs 83. The rest of platform 16 is dismantled and loaded on to another trailer 107 (FIG. 18), and cars 41 and spokes 46 are dismantled as described previously.

Keys 93 (FIGS. 9, 10) are also removed from blocks 91 to rotate the blocks, and supporting members 94 are oriented in pairs in a given direction in relation to column 77 and again locked by engaging keys 93 inside other seats 108 in flange 89.

At this point, column 77 is rotated manually to position the pairs of supporting members 94 parallel to the axis of trailer 105 (FIG. 17); hubs 43 are placed on bed 106 of trailer 105 (FIG. 16); two cars 41 are placed side by side between column 77 and each hub 43 (FIG. 16); another two cars 41 are loaded on to bed 106 of trailer 105, in front of the left hub 43 in FIG. 16; and the other cars 41 are loaded on to the other trailer 107 (FIG. 18), e.g. in two rows along the axis of trailer 107.

Each of rides 15 in FIGS. 1–5 and 6–13 comprises a cab 110 (FIGS. 1, 2 and 6, 7) for use as a ticket booth and/or control cab, located in use in a corner of platform 16, and mounted on a tired vehicle such as a caravan 111 (FIG. 19) or a camper.

The advantages of ride 15 according to the present invention will be clear from the foregoing description. In particular, it provides for a high degree of flexibility of the various movements involved, and hence greater enjoyment; for facilitating a complete turn of cars 41; and for fast disassembly and transfer from one site to another by mounting column 66, 77 on tired vehicle 102, 105.

Clearly, changes may be made to the ride as described and illustrated herein without, however, departing from the scope of the present invention. For example, the jacks may be pneumatic as opposed to hydraulic; cars 41 may be provided for a different number of passengers; changes may be made to the arrangement of cars 41 on the tired vehicles, and/or vehicle 111 for cab 110 may be dispensed with.

We claim:

1. An amusement ride featuring a plurality of cars, each adapted to accommodate at least one passenger, comprising:

at least one roundabout supporting member connected at a first end by a first articulated joint to a column rotatable about a substantially vertical first axis;

at least one support forming a roundabout rotatable about a second axis near a second end of said supporting member and adapted to support at least two cars;

wherein said support further comprises:

a plurality of radial arms removably attached to a central hub; and wherein said arms are substantially equally spaced angularly about said second axis and thereby adapted to support a corresponding number of said cars;

wherein each said arm further comprises:

a pair of appendixes each pivoting about having two pins; and each said appendix being adapted such that said cars pivot about two pins of two adjacent said arms in rotation about a third axis perpendicular to said second axis;

a motor for rotating said support in relation to said supporting member; and a jack interposed between said supporting member and said column for rotating said supporting member about said articulated joint in a radial plane relative to said column.

2. A ride as claimed in claim 1, wherein: each said car is rotated about said pins by centrifugal force; and at least one of said pins further comprises a brake operable from inside, and for regulating rotation of, said car.

3. A ride as claimed in claim 2 wherein each said car further comprises a plurality of seats arranged side by side in at least one row perpendicular to said pins.

4. A ride as claimed in claim 1, wherein:

said supporting member comprises a substantially L-shaped boom, one end of which is rotatable about said articulated joint; and said support is rotatable about a shaft, said shaft being integral with the other end of said boom.

5. A ride as claimed in claim 4, comprising:

two said articulated joints having parallel axes; and two booms, substantially diametrically opposite each other on said column, and each rotable about one of said articulated joints.

6. A ride as claimed in claim 1 wherein said column is attached to a platform forming the bed of a tired vehicle.

7. A ride as claimed in claim 6, further comprising:

a second tired vehicle for transfer of at least some of said cars; and a third tired vehicle for use as a ticket booth and/or control cab during normal operation of the ride.

8. A ride as claimed in claim 1, wherein:

said cars are removable from said arms; and said arms are removable from said hub.

9. An amusement ride featuring a plurality of cars, each adapted to accommodate at least one passenger, comprising:

at least one roundabout supporting member connected at a first end by a first articulated joint to a column rotatable about a substantially vertical first axis;

at least one support forming a roundabout rotatable about a second axis near a second end of said supporting member and adapted to support at least two cars;

a motor for rotating said support in relation to said supporting member;

wherein said supporting member comprises a boom, one end of which is rotatable about said first articulated joint and wherein said boom further comprises a second articulated joint at an end of said boom distal said first articulated joint; and wherein said ride further comprises an L-shaped arm, connected at one end through said second articulated joint to said boom and rotatable connected at the other end to said support through a shaft integral with said L-shaped arm.

10. A ride as claimed in claim 9, further comprising a hydraulic jack for rotating said L-shaped arm together with said support in relation to said column.

11. A ride as claimed in claim 9, further comprising:

a structure having a first and a second end rotatable attached at said first end about a horizontal pivot on a ride-supporting platform and adapted at said second end to support said column; and at least one hydraulic jack for rotating said structure about said pivot to raise said column.

12. A ride as claimed in claim 11, wherein the axis of said support is inclinable by an angle of over 90° in relation to the vertical.

13. A ride as claimed in claim 9, comprising:

two pairs of said supporting members;

each said supporting member being connected to said column through an articulated joint to a block; and wherein said blocks are arranged about said column approximately 90° apart about said first axis.

14. A ride as claimed in claim 13, wherein:

each said block is connected to said column through an articulated joint;

said articulated joints of each said block are substantially perpendicular to each other; and said blocks comprise lock means for maintaining said supporting members in a radial position when the ride is in use.

15. A ride as claimed in claim 14, wherein said lock means also provide for locking said blocks so as to maintain the orientation of said supporting members in oppositely directed pairs so that, for transfer, said supporting members are positionable parallel to the longitudinal axis of a transferring vehicle.

* * * * *